US006478194B2

(12) United States Patent
Haglund et al.

(10) Patent No.: US 6,478,194 B2
(45) Date of Patent: Nov. 12, 2002

(54) DISPENSING CLOSURE FOR A CONTAINER

(75) Inventors: Sylvia Maria Haglund, Oxford (GB); Christopher Paul Ramsey, Wantage (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/978,541

(22) Filed: Oct. 18, 2001

(65) Prior Publication Data

US 2002/0047023 A1 Apr. 25, 2002

(30) Foreign Application Priority Data

Oct. 19, 2000 (EP) ..... 00309228

(51) Int. Cl.[7] ..... B67B 5/00
(52) U.S. Cl. ..... 222/153.14; 222/536
(58) Field of Search ..... 222/531, 534, 222/536, 153.14

(56) References Cited

U.S. PATENT DOCUMENTS 5,054,634 A 10/1991 Margotteau
5,054,662 A * 10/1991 Santagiuliana ..... 222/531
5,356,044 A 10/1994 LaVange
5,709,318 A * 1/1998 Oder ..... 222/153.14
5,996,857 A 12/1999 Markos
6,053,374 A 4/2000 Santagiuliana

FOREIGN PATENT DOCUMENTS

DE 197 07 416 A1 8/1998
WO WO 95/11172 4/1995
WO WO 97/39962 * 10/1997

* cited by examiner

*Primary Examiner*—Philippe Derakshani
(74) *Attorney, Agent, or Firm*—Diller, Ramik & Wight

(57) ABSTRACT

A dispensing closure for a container (1) having a neck (3) with an open end (4) comprises a closure cap (7) adapted to be attached to the neck to close the container and a dispensing spout (8) formed with a dispensing passage (13) having an inlet opening (14) at one end and an outlet opening (15) at the other end. The spout (8) is mounted on the closure cap (7) for limited sliding movement between a closed position in which the dispensing passage (13) is isolated from the interior of the container and an open position in which the dispensing passage is in communication with the interior of the container. The movement of the spout from its closed to its open position follows a part circular path.

21 Claims, 4 Drawing Sheets

DISPENSING CLOSURE FOR A CONTAINER

BACKGROUND OF THE INVENTION

The invention relates to a dispensing closure for a container and in particular to a dispensing closure which includes a closure cap and a dispensing spout which can slide on the cap from a closed position to an open position.

In known closures of this type, the spout slides along a linear path. The invention provides an improved closure in which the spout slides along a part circular path.

SUMMARY OF THE INVENTION

Accordingly, the invention provides a closure cap for a container, having a dispensing spout formed with a dispensing passage having an inlet opening at one end and an outlet opening at the other end, the spout being mounted on the closure cap for limited sliding movement between a closed position in which the dispensing passage is isolated from the interior of the container and an open position in which the dispensing passage is in communication with the interior of the container, characterised in that the movement of the spout from its closed position to its open position follows an at least part circular path.

Embodiments of the invention are described below with reference to the accompanying drawings, in which

DESCRIPTION OF THE PREFERRED EMBODIMENTS

The drawings show two slight variations of a closure cap. In the first, the cap is adapted to fit onto the neck of a container having a screw thread whereas the second modified cap is adapted to be a snap fit onto the neck of a container.

Figure 1:
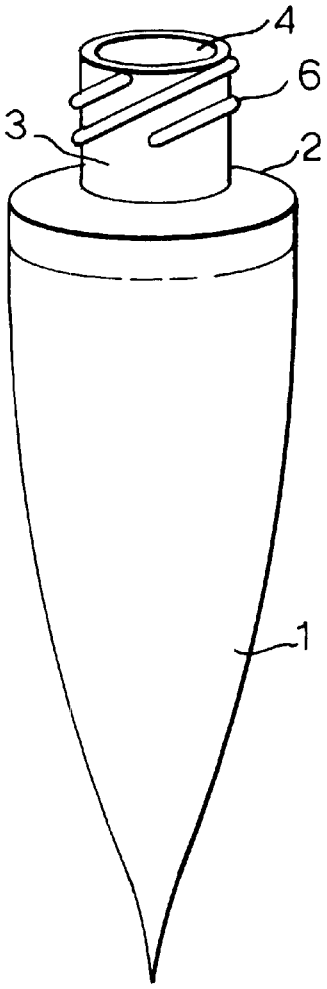
FIG. 1 is a perspective view of a squeezable container.
Figure 2:
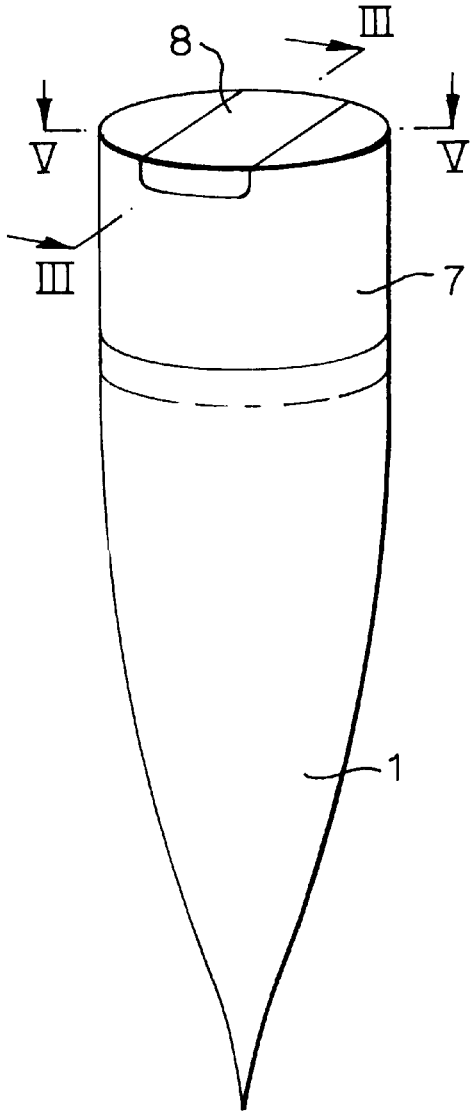
FIG. 2 is a perspective view of a squeezable container fitted with a closure cap.

FIG. 1 shows a squeezable container 1 of the type formed by a tube which is flattened at one end and formed with a shoulder 2 at the other end and a neck 3 with an open end 4. As shown, the neck is formed with a screw thread 6 although the neck may alternatively be formed to receive a closure cap in a snap fit. FIG. 2 shows the container when fitted with a closure cap 7 having a sliding spout B.

Figure 3:
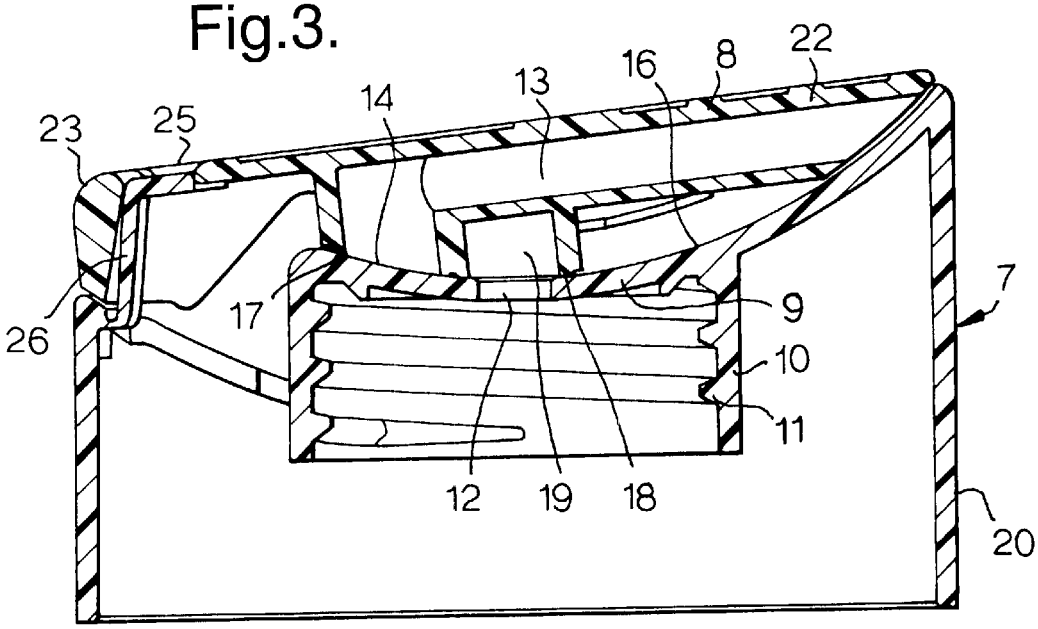
FIG. 3 is an enlarged vertical cross-section through a closure cap taken on the line III—III of FIG. 2 with the spout of the closure cap in the closed position.
Figure 4:
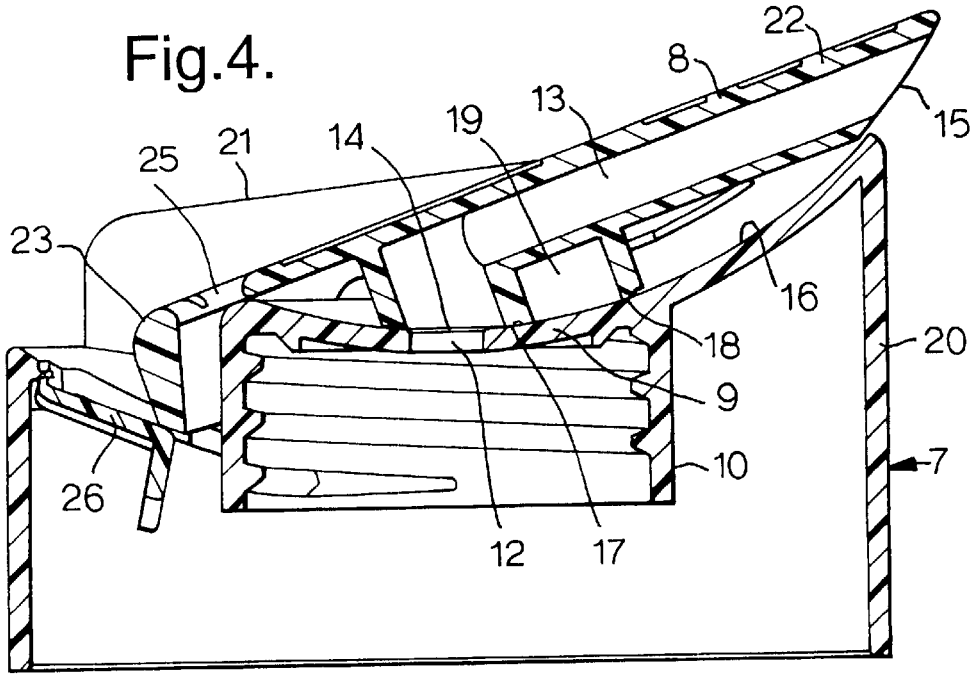
FIG. 4 is a view similar to FIG. 3 with the spout in the open position.

The closure cap is shown in more detail in FIGS. 3 and 4 and includes an end wall 9 adapted to lie over the open end

4 of the container neck and an inner cylindrical skirt 10 depending from the end wall 9 and adapted to surround the neck 3. In this embodiment, the skirt 10 is formed with an internal screw thread 11 which co-operates with the thread 6 on the neck to secure the closure cap 7 to the container 1. The end wall 9 is formed with an aperture 12.

The spout 8 is mounted on the closure cap for limited sliding movement along a part circular path between a closed position shown in FIG. 3 and an open position shown in FIG. 4.

The spout is formed with a dispensing passage 13 having an inlet opening 14 at one end and an outlet opening 15 at the other end. The dispensing passage is isolated from the interior of the container when the spout is in the closed position of FIG. 1 and communicates with the interior of the container through the aperture 12 when the spout is in its open position shown in FIG. 2.

The upper surface of the end wall 9 forms part of a curved surface 16 on which the spout slides when moving between its open and closed positions. The surface 16 is preferably part spherical as shown. The inlet opening 14 of the dispensing passage 13 is surrounded by a first sealing bead 17 which bears on the spherical surface 16 and surrounds the aperture 12 when the spout is in the open position o FIG. 4. In this position, the outlet opening 15 is exposed so that fluids in the container can be dispensed through the spout 8.

In the closed position of the spout, the first sealing bead bears on the surface 16 to close the inlet opening 14. In this position the outlet opening 15 also lies on the spherical surface and is closed thereby. A second sealing bead 18 surrounds a blind bore 19 formed on the spout. The second sealing bead 18 also bears on the surface 16 and surrounds the aperture 12 to close it off when the spout is in the closed position. This arrangement of the spherical surface 16, the beads 17, 18 and the outlet opening 15 prevent any leakage of fluids when the spout is in the closed position.

The closure cap is also formed with an outer cylindrical skirt 20 which is co-axial with the inner skirt 10 which it surrounds. The cap has a generally planar upper wall 21 which is slightly inclined to the horizontal when the cap is in the upright position shown in the Figures. The spout has an upper wall 22 which lies co-planar with the upper wall 21 of the closure cap when the spout is in the closed position.

Operation of the spout to move it from its closed position to its open position merely requires the user to press on a shoulder 23 formed on the spout at its end opposite the outlet opening 15. This causes the spout to slide across the closure cap along a part circular path defined by the part spherical surface 16. Since the centre of the part circular path is located on the axis of the closure cap, the shoulder 23 moves radially inwardly and downwardly whilst the outlet opening 15 moves radially outwardly and upwardly. Thus the outlet opening moves from a position in which it is closed off by the surface 16 to a dispensing position where it stands clear of the closure cap. One benefit of the curved path of motion of the spout is that it enables the outlet opening 15 to be closed off by the spherical surface in the closed position of the spout. As a result, the outlet opening is kept clean between uses. Another benefit of this motion is that it enables the outlet opening 15 to stand clear of the cap in the open position so that product from the container may be wiped directly onto the user's hand. The flat aspect of the outlet opening also aids this.

The arcuate surface of the cap against which the spout slides is indented towards the container. This configuration allows the spout to lie flat in the closed position and extend away from the container in the open position to allow easy dispensing of product.

A window 25 is formed in the upper wall 22 of the spout 8 and a tamper evidencing deformable element 26 appears in the window before the spout has been first operated (FIG. 3). The element 26 is deformed to the position shown in FIG. 4 during the first operation of the spout so that it no longer appears in the window. In another embodiment (not shown) a detachable tamper evidencing tab is formed on the back surface of the spout and is broken off when the spout is first actuated.

Figure 5:
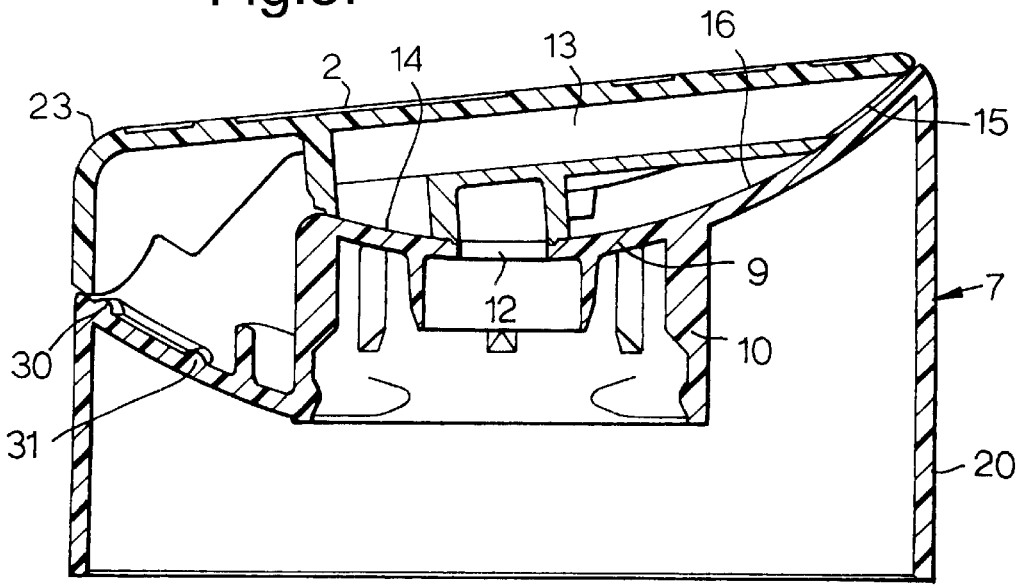
FIG. 5 is a vertical section through a modified closure cap taken on the line III—III in FIG. 2.
Figure 6:
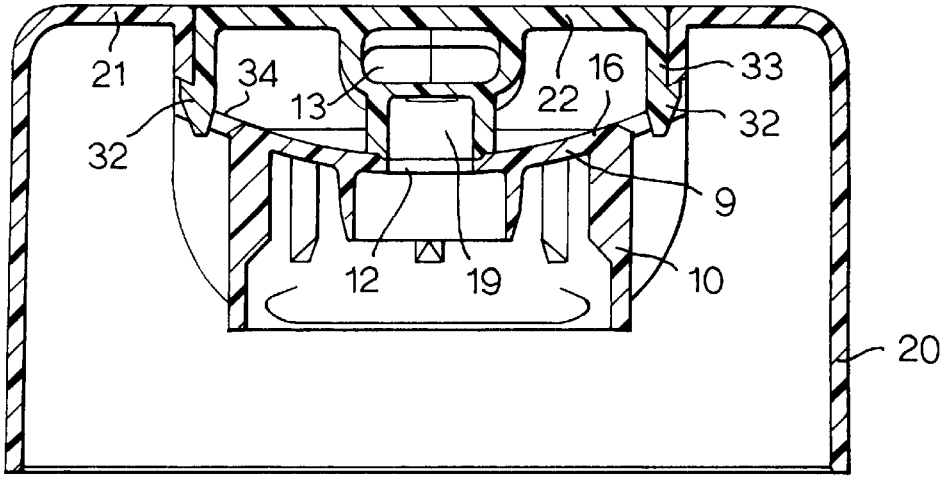
FIG. 6 is a vertical cross-section through the modified closure cap taken on the line V—V in FIG. 2.
Figure 7:
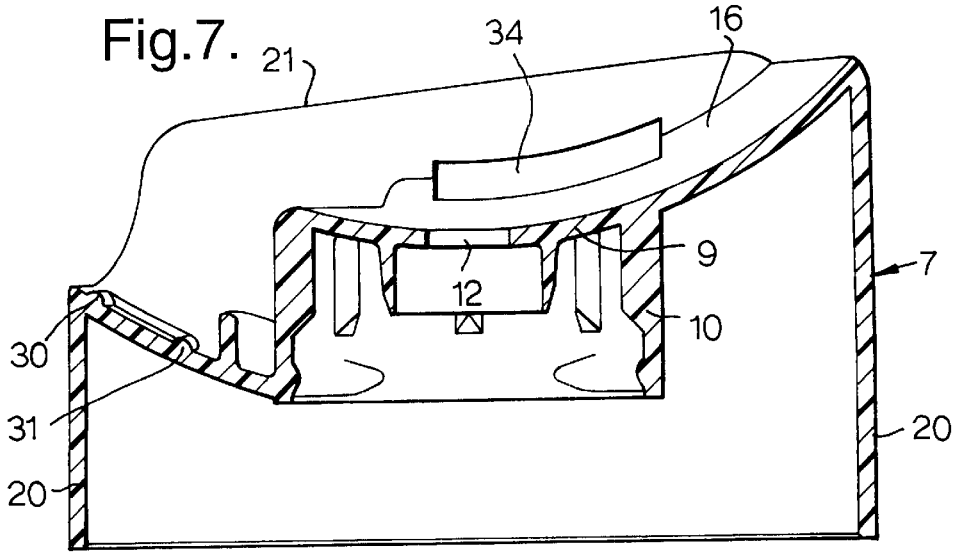
FIG. 7 is a vertical section through the modified closure cap of FIG. 5 taken on the line III—III of FIG. 2 with the spout detached therefrom.
Figure 8:
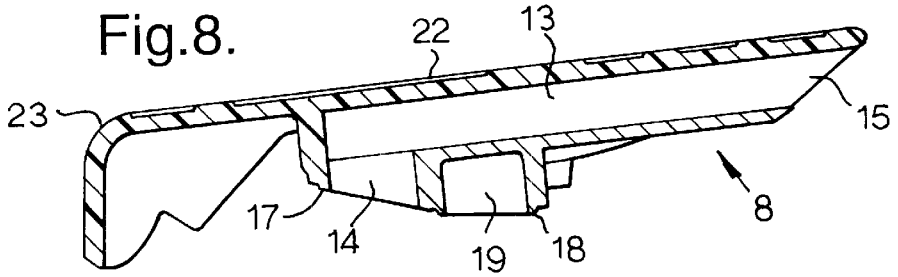
FIG. 8 is a vertical cross-section through a spout taken on the line III—III of FIG. 2.

A modified closure cap is shown in FIGS. 5 to 7. This closure cap is fundamentally the same as the cap of FIGS. 3 and 4 but is adapted to be a snap fit onto a container neck. The tamper evidencing element is not shown in the modified closure cap.

FIG. 5 shows two detents 30, 31 formed on the closure cap which operate to locate the spout positively in its closed and open positions respectively.

Figure 9:
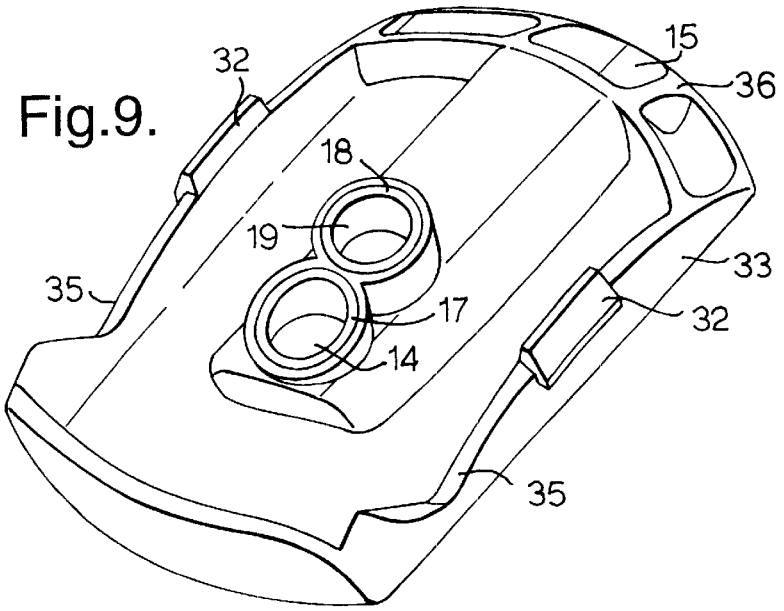
FIG. 9 is a perspective view of a spout from underneath.

As can be seen best from FIGS. 6 and 9, the spout is held onto the closure cap by means of hooks 32 formed on depending walls 33 of the spout. The hooks 32 pass through elongate openings 34 in the closure cap. The openings 34 being longer than than the hooks 32 to accommodate the sliding movement of the spout. As can be seen best from FIG. 9, the side edges 35 and front edge 36 of the spout lie on a spherical surface which bears on the spherical surface 16. The hooks are snapped into the openings 34 with the spout under a little tension so that the sealing beads are pressed firmly against the spherical surface 16.

In an alternative embodiment (not shown) the part spherical surface 16 is replaced with a part cylindrical surface, the axis of the part cylindrical surface lying perpendicular to the plain of the sectional view of FIGS. 3 to 5.

One benefit of the surface 16 being spherical, is that this is reflected in the underside surface of the end wall 9 also being spherical. This leads to a good seal being formed with the open end of the container.

It is preferred that the container cap and spout are made of different materials. In particular polypropylene homo/copolymer is preferred for the container cap and polyethylene for the spout. This combination improves both sealing and ergonomics—the softer spout being more easily gripped to retract during a single-handed operation where the container is picked up, the spout pushed, the container squeezed and the spout retracted using one hand.

Although a preferred embodiment of the invention has been specifically illustrated and described herein, it is to be understood that minor variations may be made in the apparatus without departing from the spirit and scope of the invention, as defined by the appended claims.

We claim:

1. A closure comprising a cap body including a peripheral wall (20) merging with an end wall (9) defining a curved surface (16) and having an aperture (12) through which a dispensable product is adapted to flow; a spout (8) mounted for sliding movement along an arc of said curved surface (16) between a closed nondispensing position and an open dispensing position, means (13, 14) for conducting a dispensable product from said aperture (12) through said spout (8) when said spout (8) is in the open dispensing position thereof, means (19) for preventing communication between said aperture (12) and said conducting means (13, 14) when said spout (8) is in the closed nondispensing position thereof, and said spout (8) including an outlet opening (15) which projects at least partially beyond said peripheral wall (20) when the spout (8) is in the open dispensing position thereof to optimize the dispensing of a dispensable product beyond said peripheral wall (20).

2. The closure as defined in claim 1 wherein said dispensable product conducting means (13, 14) includes an inlet opening (14), and sealing means (17) for surroundingly sealing said aperture (12) in the dispensing position of the spout (8).

3. The closure as defined in claim 1 wherein said dispensable product conducting means (13, 14) includes an inlet opening (14), and sealing means (17) carried by said spout (8) for surroundingly sealing said aperture (12) in the dispensing position of the spout (8).

4. The closure as defined in claim 1 including sealing means (18) carried by said spout (8) for surroundingly sealing said aperture (12) in the nondispensing position of the spout (8).

5. The closure as defined in claim 1 wherein said dispensable product conducting means (13, 14) includes an inlet opening (14), sealing means (17) for surroundingly sealing said aperture (12) in the dispensing position of the spout (8), and sealing means (18) carried by said spout (8) for surroundingly sealing said aperture (12) in the nondispensing position of the spout (8).

6. The closure as defined in claim 1 wherein said curved surface (16) is at least partly cylindrical.

7. The closure as defined in claim 1 wherein said curved surface (16) is at least partly spherical.

8. The closure as defined in claim 1 including cooperative means (32, 34) of said spout (8) and said cap body for retaining said spout (8) and cap body in assembled sliding relationship to each other.

9. The closure as defined in claim 1 including an inner skirt (10) in spaced relationship to said peripheral wall (20), and means carried by said inner skirt (20) for securing said closure to an associated container.

10. The closure as defined in claim 1 including an inner skirt (10) in spaced relationship to said peripheral wall (20), a pair of spaced side walls merging said inner skirt (10) with an upper portion (21) of said end wall (9), and said spout (8) having an upper wall (22) which is coplanar to the upper portion (21) of the end wall (9) in the nondispensing position of the spout (8).

11. The closure as defined in claim 1 including window means (25) in an upper portion (21) of said end wall (9) through which tamper-indicating means (26) is viewable prior to the first movement of the spout (8) from the nondispensing position to the dispensing position thereof.

12. The closure as defined in claim 5 including cooperative means (32, 34) of said spout (8) and said cap body for retaining said spout (8) and cap body in assembled sliding relationship to each other.

13. The closure as defined in claim 5 including an inner skirt (10) in spaced relationship to said peripheral wall (20), a pair of spaced side walls merging said inner skirt (10) with an upper portion (21) of said end wall (9), and said spout (8) having an upper wall (22) which is coplanar to the upper portion (21) of the end wall (9) in the nondispensing position of the spout (8).

14. The closure as defined in claim 5 including window means (25) in an upper portion (21) of said end wall (9) through which tamper-indicating means (26) is viewable prior to the first movement of the spout (8) from the nondispensing position to the dispensing position thereof.

15. The closure as defined in claim 13 including window means (25) in an upper portion (21) of said end wall (9) through which tamper-indicating means (26) is viewable prior to the first movement of the spout (8) from the nondispensing position to the dispensing position thereof.

16. A closure comprising a cap body including a peripheral wall (20) merging with an end wall (9) defining a curved surface (16) and having an aperture (12) through which a dispensable product is adapted to flow; a spout (8) mounted for sliding movement along an arc of said curved surface (16) between a closed nondispensing position and an open dispensing position, means (13, 14) for conducting a dispensable product from said aperture (12) through said spout (8) when said spout (8) is in the open dispensing position thereof, means (19) for preventing communication between said aperture (12) and said conducting means (13, 14) when said spout (8) is in the closed nondispensing position thereof, first sealing means (17) for surroundingly sealing said aperture (12) in the dispensing position of the spout (8), and second sealing means (18) carried by said spout (8) for surroundingly sealing said aperture (12) in the nondispensing position of the spout (8).

17. The closure as defined in claim 16 wherein said second sealing means (18) surrounds a blind bore of said communication preventing means (19) of the spout (8) in the nondispensing position of the spout (8).

18. The closure as defined in claim 16 including window means (25) in an upper portion (21) of said end wall (9) through which tamper-indicating means (26) is viewable prior to the first movement of the spout (8) from the nondispensing position to the dispensing position thereof.

19. A closure comprising a cap body including a peripheral wall (20) merging with an end wall (9) defining a curved surface (16) and having an aperture (12) through which a dispensable product is adapted to flow; a spout (8) mounted for sliding movement along an arc of said curved surface (16) between a closed nondispensing position and an open dispensing position, means (13, 14) for conducting a dispensable product from said aperture (12) through said spout (8) when said spout (8) is in the open dispensing position thereof, means (19) for preventing communication between said aperture (12) and said conducting means (13, 14) when said spout (8) is in the closed nondispensing position thereof, and window means (25) in an upper portion (21) of said end wall (9) through which tamper-indicating means (26) is viewable prior to the first movement of the spout (8) from the nondispensing position to the dispensing position thereof.

20. The closure as defined in claim 19 wherein said tamper-indicating means (26) is a deformable wall portion of said end wall (9).

21. The closure as defined in claim 19 wherein said tamper-indicating means (26) is a deformable wall portion of said end wall (9) along said curved surface (16).

* * * * *